US007600554B1

(12) United States Patent
Wright et al.

(10) Patent No.: US 7,600,554 B1
(45) Date of Patent: Oct. 13, 2009

(54) PORTABLE ACCIDENT BARRIER

(76) Inventors: Felicia M Wright, 103 White Cedar La., Yorktown, VA (US) 23693; Emmitt Bruce Clore, 3449 Daisy Crescent, Virginia Beach, VA (US) 23453

( * ) Notice: Subject to any disclaimer, the term of this patent is extended or adjusted under 35 U.S.C. 154(b) by 0 days.

(21) Appl. No.: 12/137,970

(22) Filed: Jun. 12, 2008

(51) Int. Cl.
*A47H 23/00* (2006.01)
*A47H 3/80* (2006.01)
*A47G 5/00* (2006.01)

(52) U.S. Cl. ..... 160/327; 160/351

(58) Field of Classification Search ..... 160/135, 160/351, 179, 229.1, 237, 24, 327; 256/65.01, 256/DIG. 5; 403/177, 3, 340, 4, 52, 6
See application file for complete search history.

(56) References Cited

U.S. PATENT DOCUMENTS 4,014,521 A * 3/1977 Berman ..... 256/1
4,124,196 A * 11/1978 Hipskind ..... 256/1
4,969,500 A * 11/1990 Makosa ..... 160/135
5,029,819 A 7/1991 Kane
5,402,999 A * 4/1995 Keehn, Sr. ..... 473/472
5,553,648 A * 9/1996 Goharjou ..... 160/135
5,875,597 A * 3/1999 Gingrich et al. ..... 52/239
6,036,249 A 3/2000 Kuntz
6,142,701 A 11/2000 Falcon
6,969,185 B1 * 11/2005 Adair ..... 362/542
7,217,061 B2 * 5/2007 Stratton ..... 404/6
2006/0060310 A1 * 3/2006 Haugen ..... 160/135

* cited by examiner

*Primary Examiner*—Katherine W Mitchell
*Assistant Examiner*—Jeremy C Ramsey

(57) ABSTRACT

A multi-segmented, highly-portable highly-stable accident barrier device for obscuring accident sites to prevent on-looking by passersby, traffic congestion, and residual collisions, the device consisting of two telescopic poles with stabilizing feet and a mesh tarpaulin extended therebetween, the tarpaulin having a plurality of loops along each side edge adapted to slidably attach around the poles, a plurality of ventilation slits for passage of wind therethrough, a hook and hook fastener along its bottom edge, reflective designs, as well as additional extension screen sections, also having hook and loop fasteners along each edge and ventilation slits, for removable attachment to the tarpaulin. A method for using the device is also provided.

14 Claims, 4 Drawing Sheets

PORTABLE ACCIDENT BARRIER

FIELD OF THE INVENTION

The present invention relates to new and useful improvements in screens for obscuring accident sites and, more specifically, to a multi-segmented, highly-portable, highly-stable accident barrier device for shielding an accident scene to prevent gawking by passersby, traffic congestion, and residual collisions, the device consisting of two telescopic poles with stabilizing feet and a mesh tarpaulin extended therebetween, the tarpaulin having a plurality of loops along each side edge adapted to slidably attach around the poles, a plurality of ventilation slits, an industrial-grade hook and hook fastener along its bottom edge, and reflective designs, as well as additional screen sections, also having hook and loop fasteners along each edge for removable attachment to the tarpaulin and to each other.

BACKGROUND OF THE INVENTION

Prior art provides various accident screening devices to obstruct the view of an accident scene to passing motorists, to maintain the flow of traffic not only in the traffic lane in which the accident has occurred but also in the opposite lane as a result of "rubber-necking", and to prevent secondary accidents that may be attributable to the slowdown and jamming of traffic at accident sites. A multi-segmented highly-portable, yet stable, screen which is adjustable both in vertical and horizontal directions, which is easily carried and deployed by a single individual at an accident site is needed to address the foregoing concerns. The present portable accident barrier device addresses the foregoing problems by two lightweight vertically-extending telescopic poles with stabilizing feet and a lightweight mesh tarpaulin extended therebetween, the tarpaulin having a plurality of loops along each side edge adapted to slidably attach around the poles for horizontal adjustment, a plurality of ventilation slits, an industrial-grade hook and hook fastener along its bottom edge, and bearing reflective designs, as well as additional screen sections, also having hook and loop fasteners along each edge for attachment to the tarpaulin, for removable attachment to the tarpaulin and to each other.

SUMMARY OF THE INVENTION

The present portable accident barrier device is a multi-segmented highly-portable, yet stable, screen which is adjustable both in vertical and horizontal directions. The present consists of two lightweight vertically-extending telescopic poles with stabilizing feet and a lightweight mesh tarpaulin extended therebetween, the tarpaulin having a plurality of loops along each side edge adapted to slidably attach around the poles for horizontal adjustment, a plurality of ventilation slits, an industrial-grade hook and hook fastener along its bottom edge, and additional vertical extender sections, also having hook and loop fasteners along each edge for attachment to the tarpaulin, and reflective designs.

The telescopic extension poles are preferably 5 feet in height. Each extension pole has an expansion peg which locks into slot. The expansion peg may be flipped upwardly to become a female expansion slot for attachment to another extension pole. The extender sections are preferably 2 feet high with the width the same as the tarpaulin. The tarpaulin may also display a logo.

The present portable accident barrier device is easily carried and deployed by a single individual at an accident site. To assemble the present device, an individual removes the device from a carrying case and lays the device on the ground. The individual stands and places the device, on its side, at the center of the vehicle. Then, the individual unrolls one end of the device toward one end of the vehicle and then goes back to the center and unrolls the other end of the device toward the opposite end of the vehicle. The individual may add extender sections to the bottom of the tarpaulin. Then each extension pole is placed in a vertical position to stand upon its support feet. If vertical extension is desired, the individual pushes a button on the side of each extension pole to increase its height and locks the button into the slot until the button clicks into place. To disassemble the device, an individual performs the steps for assemblage in reverse order.

The present portable accident barrier device conceals vehicles, bodies of deceased or injured persons, and damages to remove the need to gawk at an accident scene. The device, thus, assists in keeping traffic flowing smoothly to eliminate traffic jams, while also reducing the potential for another traffic collision. The device further provides privacy and dignity for distressed motorists and their passengers involved in an accident in that they would not be in full view of every passing motorist while in a state of hysteria, confusion, suffering, stress or anguish. In addition, police officers and emergency medical services are able to concentrate their efforts on providing assistance to those involved in the traffic incident. The reflective designs on the tarpaulin increase awareness of an approaching accident scene, such as at night and during other conditions of low visibility, such as in snowstorms and rain. The device may also be used in variety of other situations such as to caution passing motorists while changing a flat tire or while stopping to allow an engine to cool down, emergency medical situations, other emergency situations, as well as by utility and construction crews while performing roadside work.

As such, the general purpose of the improved portable accident barrier device which has all of the advantages of the prior art mentioned heretofore and many novel features that result in an improved portable accident barrier device which is not anticipated, rendered obvious, suggested, or even implied by the prior art, either alone or in combination thereof.

An object of the present portable accident barrier device is to screen accident scenes from gawking by passing motorists.

Another object of the present portable accident barrier device is to promote highway safety and free flow on highway traffic by obscuring an accident site.

Yet another object of the present portable accident barrier device is to assist police officers in traffic management so that the officers as well as emergency medical personnel may focus on providing service to those involved in a traffic accident.

Still another object of the present device is to provide an accident barrier device which is highly portable and easily and quickly assembled and disassembled by a single individual.

Still yet another object of the present device is to enhance awareness of the presence of an accident scene, such as at night, during a snowstorm, or during a rainstorm.

Still yet another object of the present portable accident barrier device is to a multi-segmented highly-portable, yet highly-stable, screen which is adjustable both in vertical and horizontal directions, such device consisting of two lightweight vertically-extending telescopic poles with stabilizing feet and a lightweight mesh tarpaulin extended therebetween, the tarpaulin having a plurality of loops along each side edge adapted to slidably attach around the poles for horizontal adjustment, a plurality of ventilation slits, an industrial-grade hook and hook fastener along its bottom edge, and additional vertical extender sections, also having hook and loop fasteners along each edge for attachment to the tarpaulin, and reflective designs.

Even still another object of the present portable accident barrier device is to provide a barrier device which may be used in a variety of situations, such as to caution passing motorists while changing a flat tire or cooling an overheated engine on the shoulder of the road or while performing roadside utility or construction work.

Thus has been broadly outlined the more important features of the improved portable accident barrier device so that the detailed description thereof that follows may be better understood and in order that the present contribution to the art may be better appreciated.

These together with additional objects, features and advantages of the improved portable accident barrier device will be readily apparent to those of ordinary skill in the art upon reading the following detailed description of presently preferred, but nonetheless illustrative, embodiments of the improved portable accident barrier device when taken in conjunction with the accompanying drawings. In this respect, before explaining the current embodiments of the improved portable accident barrier device in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the concept of this disclosure may be readily utilized as a basis for the design of other structures, methods, and kits for carrying out the several purposes of the improved portable accident barrier device. It is therefore important that the claims be regarded as including such equivalent constructions insofar as they do not depart from the spirit and scope of the present invention.

Objects of the improved portable accident barrier device, along with various novel features that characterize the invention are particularly pointed out in the claims forming a part of this disclosure. For better understanding of the improved portable accident barrier device, its operating advantages and specific objects attained by its uses, refer to the accompanying drawings and description.

DETAILED DESCRIPTION OF THE DRAWINGS

Figure 1:
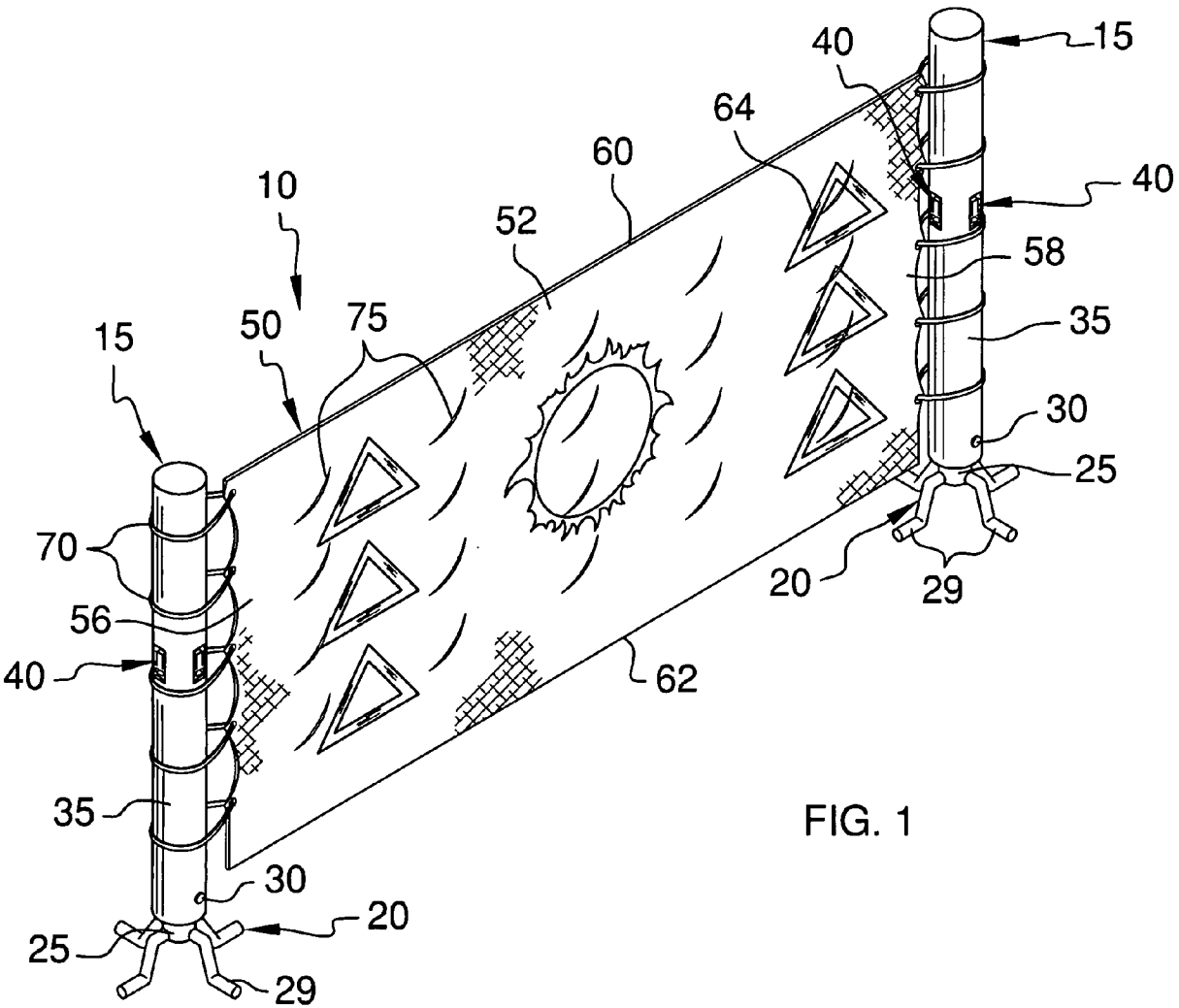
FIG. 1 is an isometric view of an assembled device illustrating poles in retracted position.
Figure 2:
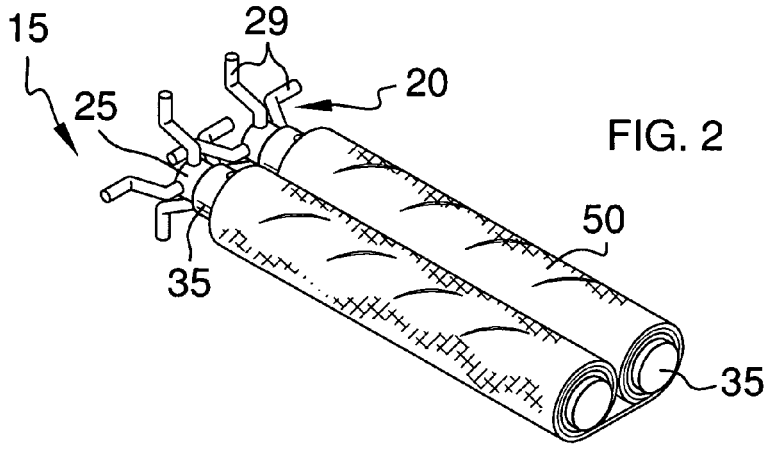
FIG. 2 is an isometric view of a device in complete disassembled position.

With reference now to the drawings, and in particular FIGS. 1 through 5 thereof, examples of the employing the principles and concepts of the present portable accident barrier device, generally designated by the reference number 10, will be described.

Referring to FIGS. 1 through 5, the present portable accident barrier device 10 consists of a pair of telescopic pole assemblies 15 of substantially equal length and a tarpaulin 50. The pole assemblies 15 each have a base 20 including a vertically-oriented cylindrical post 25 having four cylindrical S-shaped ground-engaging feet 29 affixed equidistantly apart to the post 25 in an downwardly and outwardly relationship thereto and further having a locking means 30 therein. Each pole assembly 15 further consists of a cylindrical body 35 with a diameter greater than that of the post and coupled thereto in a concentric relationship therewith. The body 35 is in longitudinally slidable communication with the post 25 and is adapted to removably engage the locking means 30 to lock the body 35 into a user-selected height. The body 35 further consists of at least one assembly engagement means 40 adapted to attach at least two portable barrier devices 10 together. As shown generally in FIGS. 1 and 3, and in more detail in FIGS. 4 and 5, the assembly engagement 40 means may be a slot 42 on the exterior of the pole assembly 15 body 35 and outwardly pivotable peg 45 adapted to lock into the slot 42 of another portable accident barrier device 10 wherein the peg 45 may be flipped upwardly to become a female slot 42 for attachment to another device 10. The pole assemblies 15 may be constructed from lightweight aluminum.

The tarpaulin 50 has a front side 52, a rear side 54, a left edge 56, a right edge 58, a top edge 60 and a bottom edge 62. Further, the tarpaulin 50 slidably engages the pole assemblies 15 via a plurality of loops 70 vertically spaced along the left edge 56 and the right edge 58 adapted to slidably engage the body 35 for maintaining the tarpaulin 50 in upright orientation. A plurality of elongated narrow slits 75 in the tarpaulin 50 permit passage of wind therethrough. A hook and loop fastener 68 runs continuously across the width of the bottom edge 62 of the tarpaulin 50 rear side 54. The tarpaulin 50 is constructed of a lightweight, substantially opaque mesh. The substantially mesh construction allows air to pass through the tarpaulin 50, while obscuring an accident scene from passing motorists.

A plurality of strips 64 of highly light reflective fabric are affixed to the front side 52 of the tarpaulin 50. The strips 64 are preferably positioned relative to one another to form a plurality of triangular shapes. The triangular shape signifies caution to passing motorists to warn them of the presence of an accident scene.

The portable accident barrier device 10 pole assembly 15 is extendable to 5 feet in height. A logo may also be placed on the tarpaulin 50. The logo may be used to advise passing motorists of the presence of an accident, to provide information to passing motorists, or for advertising.

Figure 3:
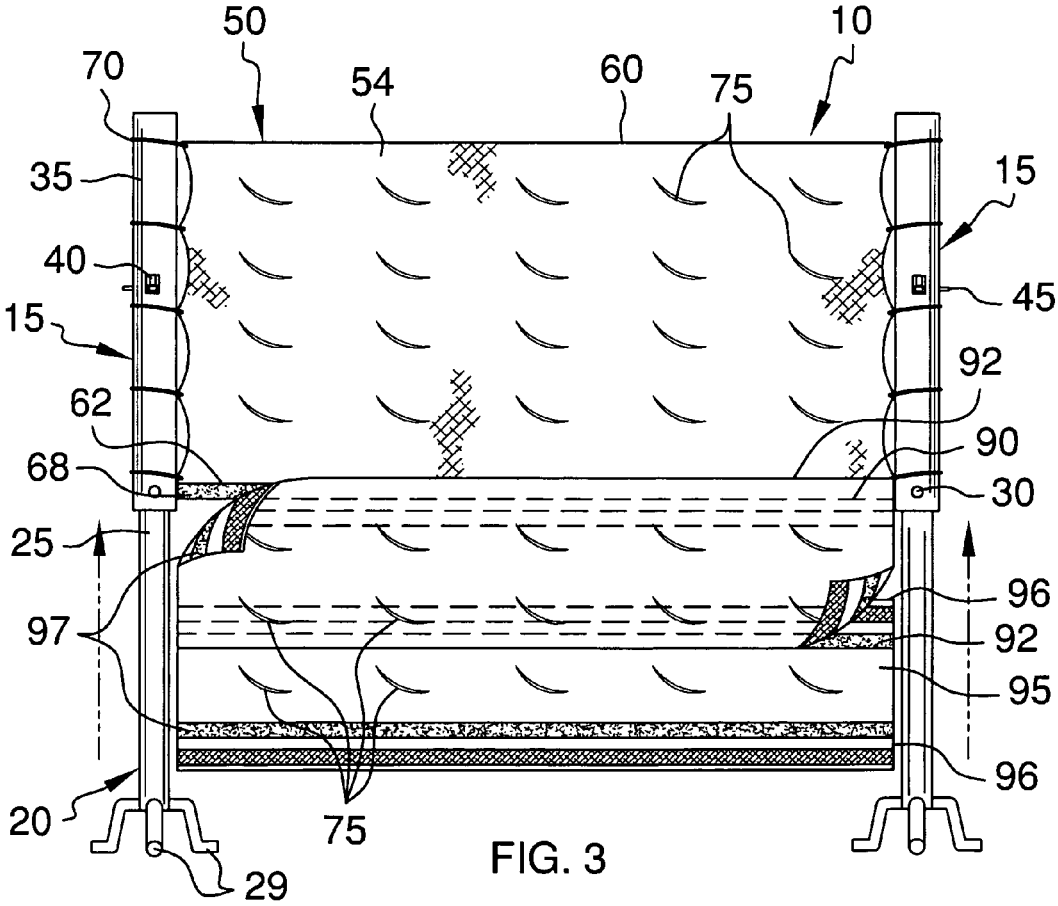
FIG. 3 is a rear elevational view of an assembled device illustrating poles in extended position and extender sections attached to a tarpaulin.
Figure 4:
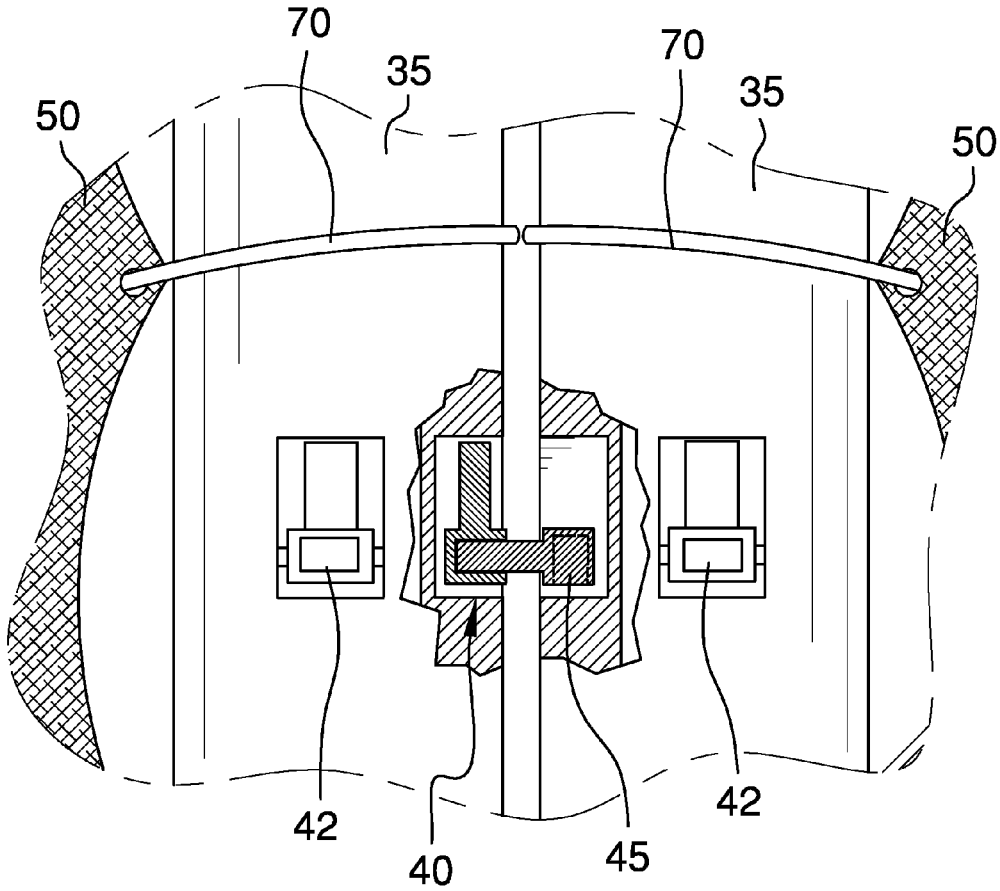
FIG. 4 is a detailed view of an expansion peg assembly.

An alternate embodiment further provides a first screen section 90 and a second screen section 95. Each section 90, 95 is a substantially opaque sheet of lightweight mesh fabric, such as nylon mesh, having an upper edge 92 and a lower edge 96. Each section 90, 95 consists of an attachment means 97 adapted to attach the first screen section 90 and the second screen section 95 to the tarpaulin 50. FIG. 3 illustrates the attachment means as a hook and loop fastener 68 running continuously along the upper edge 92 and the lower edge 96 of each of the screen sections 90, 95, the hook and loop fastener 68 adapted to removably engage the hook and loop fastener 68 on the bottom edge 62 of the tarpaulin 50 rear side 54 and, further adapted to removably engage 68 the first screen section 90 to said second screen section 95. Each section 90, 95 further consists a plurality of elongated narrow slits 75 therein to permit passage of wind therethrough. The slits 75 in the tarpaulin 50, in the first screen section 90 and in the second screen section 95 are preferably crescent-shaped to provide a calming aesthetic effect to the accident victims, as well as to passing motorists. Additional screen sections may be also provided for adding height or replacement screen sections. One embodiment provides a first screen section 90 and a second screen section 95 which have a height of substantially 2 feet and a width substantially the same as the width of said tarpaulin. The triangular shape of the light reflective strips 64 serve to caution to passing motorists of the presence of an accident scene.

Figure 5:
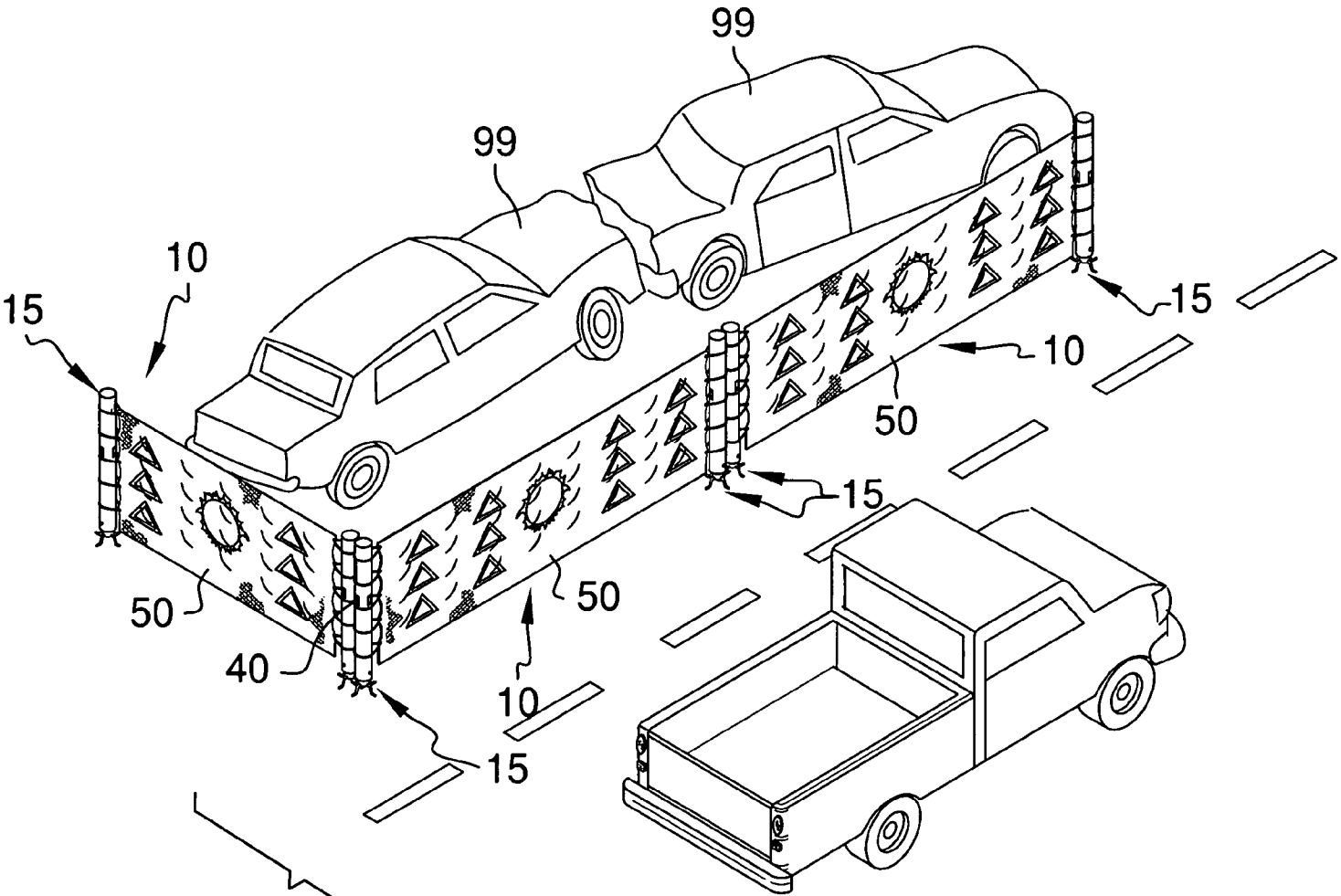
FIG. 5 is an isometric, in use view illustrating the device in use at an accident scene.

Operation:

To assemble the present device 10, an individual user removes the device 10 from storage, such as in a carrying case or a vehicle, and places the device 10, on its side, on the ground. Then, as illustrated in FIG. 5, the user unrolls one end of the device 10 in one direction and then goes back to the center and unrolls the other end of the device 10 in the opposite direction. The individual may add a first screen section 90 and second screen section 95 to the bottom edge 62 of the tarpaulin 50 by overlapping the hook and loop fastener 68 of the tarpaulin 50 and the hook and loop fastener 68 on the first screen section 90 and second screen section 95 to each other. Next each pole assembly 15 is placed in a vertical position to stand upon its support feet 29. If vertical extension is desired, the individual engages the locking means 30 to lock the body 35 into a user-selected height. To disassemble the device, an individual performs the steps for assemblage in reverse order. If the pole assemblies 15 have been extended to their height, the user disengages the locking means 30 to retract the pole assemblies 15 back to their original height. Then the user places both pole assemblies 15, tarpaulin 50, as well as the first screen section 90 and second screen section 95, if used, on their sides. The screen sections 90, 95 are unattached from the device 10. Then one end of the tarpaulin 50 is rolled up around a pole assembly 15 and the other end of the tarpaulin 50 is rolled up around the other pole assembly 15 until the pole assemblies are adjacent to each other. The device 10 is then placed back into storage to be used again.

With respect to the above description then, it is to be realized that the optimum dimensional relationships for the parts of the portable accident barrier device, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A portable accident barrier device comprising:

a pair of telescopic pole assemblies of substantially equal length, each of said assemblies comprising:

a base including a vertically-oriented cylindrical post having four cylindrical S-shaped ground engaging feet affixed equidistantly apart to said post in an downwardly and outwardly relationship thereto and having a locking means therein;

a cylindrical body with a diameter greater than that of the post and coupled thereto in a concentric relationship therewith, said body in longitudinally slidable communication with said post and adapted to removably engage said locking means adapted to lock said body into a user-selected height, said body further comprising an assembly engagement means adapted to attach at least two portable barrier devices together; and a lightweight, substantially opaque mesh tarpaulin slidably engaged between said pole assemblies, said tarpaulin having a front side, a rear side, a left edge, a right edge, a top edge, and a bottom edge, said tarpaulin comprising:

a plurality of loops vertically spaced along said left edge and said right edge adapted to slidably engage said body for maintaining said tarpaulin in upright orientation;

a plurality of elongated narrow slits in said tarpaulin to permit passage of wind therethrough;

a hook and loop fastener running continuously across said bottom edge on said tarpaulin rear side; and a plurality of strips of highly light reflective fabric affixed to said front side; said assembly engagement means is a slot on the exterior of said body having an outwardly pivotable peg adapted to lock into a slot of an adjacent portable accident barrier device with another body having the same structure as said body, and wherein said peg is adapted to be flipped up and to become a female expansion slot for attaching to another peg with the same structure as said peg on the adjacent body.

2. The portable accident barrier device of claim 1 wherein said strips are positioned relative to one another to form a plurality of triangular shapes.

3. The portable accident barrier device of claim 1 wherein said slits are crescent-shaped.

4. The portable accident barrier device of claim 1 wherein said pole assembly is extendable to 5 feet in height.

5. The portable accident barrier device of claim 1 wherein said pole assemblies are constructed from lightweight aluminum.

6. A portable accident barrier device comprising:

a pair of telescopic pole assemblies of substantially equal length, each of said assemblies comprising:

a base including a vertically-oriented cylindrical post having four cylindrical S-shaped ground engaging feet affixed equidistantly apart to said post in an downwardly and outwardly relationship thereto and having a locking means therein;

a cylindrical body with a diameter greater than that of the post and coupled thereto in a concentric relationship therewith, said body in longitudinally slidable communication with said post and adapted to removably engage said locking means adapted to lock said body into a user-selected height, said body further comprising an assembly engagement means adapted to attach at least two portable barrier devices together;

a lightweight, substantially opaque mesh tarpaulin slidably engaged between said pole assemblies, said tarpaulin having a front side, a rear side, a left edge, a right edge, a top edge, and a bottom edge, said tarpaulin comprising:

a plurality of loops vertically spaced along said left edge and said right edge adapted to slidably engage said body for maintaining said tarpaulin in upright orientation;

a plurality of elongated narrow slits in said tarpaulin to permit passage of wind therethrough;

a hook and loop fastener running continuously across said bottom edge on said tarpaulin rear side; and a plurality of strips of highly light reflective fabric affixed to said front side; and a first screen section and a second screen section, each comprising a substantially opaque sheet of lightweight mesh fabric having an upper edge and a lower edge and further having an attachment means adapted to attach said first screen section and said second screen section to said tarpaulin and each further having a plurality of elongated narrow slits therein to permit passage of wind therethrough; said assembly engagement means is a slot on the exterior of said body having an outwardly pivotable peg adapted to lock into a slot of an adjacent portable accident barrier device with another body having the same structure as said body, and wherein said peg is adapted to be flipped up and to become a female expansion slot for attaching to another peg with the same structure as said peg on the adjacent body.

7. The portable accident barrier of claim 6 wherein said attachment means is a hook and loop fastener running continuously along said upper edge and said lower edge of each of said screen sections, said hook and loop fastener adapted to removably engage said hook and loop fastener on said bottom edge of said tarpaulin rear side and, further adapted to removably engage said first screen section to said second screen section.

8. The portable accident barrier device of claim 6 wherein said strips are positioned relative to one another to form a plurality of triangular shapes.

9. The portable accident barrier device of claim 6 wherein said slits are crescent-shaped.

10. The portable accident barrier device of claim 6 wherein said pole assembly is extendable to 5 feet in height.

11. The portable accident barrier device of claim 6 wherein said first screen section and said second screen section have a height of 2 feet and a width substantially the same as the width of said tarpaulin.

12. A method of using the portable accident barrier device of claim 6 comprising the steps of:

removing said device from storage;

placing said device, on its side, on the ground unrolling one end of said device in one direction;

unrolling an opposite other end of said device in an opposite direction;

adding a first screen section to the bottom edge of the tarpaulin by overlapping the hook and loop fastener of the tarpaulin bottom edge and the hook and loop fastener on the first screen section;

adding a second screen section to said first screen section by overlapping the hook and loop fastener of said second screen section to said hook and loop fastener on said lower edge of said first screen section;

placing said device in a vertical position; and engaging the locking means and extending said body on each pole assembly to lock said device into a user-selected height.

13. The method of using the portable accident barrier device of claim 12 further comprising the steps of:

disengaging said locking means to retract said pole assemblies back to original height;

placing device on its side on the ground after disengaging said locking means;

unattaching said first screen section from said tarpaulin;

unattaching said second screen section from said first screen section;

rolling one end of said tarpaulin around a pole assembly and the opposite end of said tarpaulin around another pole assembly until said pole assemblies are adjacent to each other; and storing said device.

14. A method of using the portable accident barrier device of claim 1 comprising the steps of: removing said device from storage; placing said device on its side on the ground; unrolling one end of said device in one direction; unrolling an opposite other end of said device in an opposite direction; placing said device in a vertical position; and engaging the locking means and extending said body on each pole assembly to lock said device into a user-selected height.

* * * * *